US012297726B2

(12) United States Patent
Yuan et al.

(10) Patent No.: US 12,297,726 B2
(45) **Date of Patent: *May 13, 2025**

(54) HEAT RADIATOR AND TURBO FRACTURING UNIT COMPRISING THE SAME

(71) Applicant: YANTAI JEREH PETROLEUM EQUIPMENT & TECHNOLOGIES CO., LTD., Shandong (CN)

(72) Inventors: Weipeng Yuan, Shandong (CN); Rikui Zhang, Shandong (CN); Peng Zhang, Shandong (CN); Xiao Yu, Shandong (CN); Xin Qi, Shandong (CN); Tingrong Ma, Shandong (CN); Wenwen Liu, Shandong (CN); Zhaoyang Xu, Shandong (CN); Chao Lin, Shandong (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/361,547

(22) Filed: Jul. 28, 2023

(65) Prior Publication Data

US 2023/0383634 A1 Nov. 30, 2023

Related U.S. Application Data

(63) Continuation of application No. 17/148,938, filed on Jan. 14, 2021, now Pat. No. 11,713,663.

(30) Foreign Application Priority Data

Nov. 6, 2020 (CN) ..... 202011232423.8
Nov. 6, 2020 (CN) ..... 202022551347.9

(51) Int. Cl.
*E21B 43/26* (2006.01)
*F01P 3/18* (2006.01)
(Continued)

(52) U.S. Cl.
CPC ..... *E21B 43/26* (2013.01); *E21B 43/2607* (2020.05); *F01P 3/18* (2013.01);
(Continued)

(58) Field of Classification Search
CPC .... F01P 11/10; F01P 11/12; F01P 7/10; F01P 3/18
See application file for complete search history.

(56) References Cited

U.S. PATENT DOCUMENTS 6,435,264 B1 8/2002 Konno et al.
2006/0144350 A1 7/2006 Nakashima
(Continued)

FOREIGN PATENT DOCUMENTS

CN 102602323 A 7/2012
CN 105484835 A 4/2016
(Continued)

OTHER PUBLICATIONS

International Search Report dated Jul. 28, 2021 for International Application No. PCT/CN2020/136931, 5 pages.

*Primary Examiner* — Kevin A Lathers
(74) *Attorney, Agent, or Firm* — Crowell & Moring

(57) ABSTRACT

The present disclosure relates to a heat radiator and a turbo fracturing unit comprising the same. The heat radiator includes: a cabin; a heat radiation core disposed at the inlet and configured to allow a gas/air to pass therethrough; a gas/air guide device disposed at the outlet and configured to suction the air within the cabin to the outlet; and noise reduction structure disposed within the cabin, which is of a structure progressively converging to the outlet. The heat
(Continued)

radiator is configured to enable the gas/air to enter the cabin via the inlet, then sequentially pass through the heat radiation core, a surface of the noise reduction structure and the gas/air guide device, and finally be discharged out of the cabin. The heat radiator according to the present disclosure is a suction-type heat radiator which can regulate the speed of the gas/air guide device based on the temperature of the gas/air at the inlet, thereby avoiding energy waste and unnecessary noise. The smooth curved surface of the noise reduction structure can reduce noise without affecting the gas/air flow.

19 Claims, 9 Drawing Sheets

(51) Int. Cl.

| | |
|---|---|
| ***F01P 5/06*** | (2006.01) |
| ***F01P 7/10*** | (2006.01) |
| ***F01P 7/16*** | (2006.01) |
| ***F01P 11/10*** | (2006.01) |
| ***F01P 11/12*** | (2006.01) |

(52) U.S. Cl.
CPC ..... *F01P 5/06* (2013.01); *F01P 7/10* (2013.01); *F01P 7/16* (2013.01); *F01P 11/10* (2013.01); *F01P 11/12* (2013.01); *F01P 2025/42* (2013.01)

(56) References Cited

U.S. PATENT DOCUMENTS

| | | | | |
|---|---|---|---|---|
| 2011/0115235 | A1* | 5/2011 | Steffl ..... | H02P 9/48 290/1 B |
| 2016/0010557 | A1 | 1/2016 | Matsuyama et al. | |
| 2017/0284060 | A1 | 10/2017 | Yamazaki | |

FOREIGN PATENT DOCUMENTS

| | | | |
|---|---|---|---|
| CN | 106593620 | A | 4/2017 |
| CN | 110005516 | A | 7/2019 |
| CN | 110306621 | A | 10/2019 |
| CN | 110735688 | A | 1/2020 |
| CN | 210284212 | U | 4/2020 |

* cited by examiner

HEAT RADIATOR AND TURBO FRACTURING UNIT COMPRISING THE SAME

CROSS REFERENCES

This application is a continuation of and claims the benefit of priority to U.S. patent application Ser. No. 17/148,938 Filed on Jan. 14, 2021, which is based on and claims the benefit of priority to Chinese Patent Application Nos. 202022551347.9 and 202011232423.8 both filed on Nov. 6, 2020. These prior patent applications are herein incorporated by reference in their entireties.

FIELD

The present disclosure relates to a heat radiator and a turbo fracturing unit comprising the same.

BACKGROUND

Nowadays, the heat radiators applied to turbo fracturing units include vertical heat radiators, horizontal radiators, and cabin heat radiators. Wherein, the vertical heat radiator occupies small mounting space but produces loud noise, and hot air flowing therefrom impacts other components of the unit, resulting in a limited range of applications. For the horizontal heat radiator, the hot air blows upwardly therefrom without impacting other components or units. However, the cores therein are arranged in the form of multiple layers, each layer of cores exhibits poor performances in heat radiation, and difficult for silica dust and guar powder to pass through, which causes insufficient heat radiation and blocked core fins, and such heat radiator therefore requires frequent maintenance. The horizontal heat radiator has a further shortcoming of loud noise. In addition, the cores for the vertical and the horizontal heat radiator may be damaged by flying sand, branches and the like during travelling, which incurs high costs.

Although the cabin heat radiator can solve the problems of arrangement of units and blocked cores, the problem of loud noise still exists. In order to solve the noise problem of the cabin radiator, some measures are utilized in the turbo fracturing units including: lowering rotating speed of the fan of the heat radiator, enlarging the size of the heat radiator, providing an additional noise reduction cabin outside the units, and the like. Such measures may lead to the problem of being overweight.

On the other hand, when a set of fracturing units are operating, the units are arranged in parallel with a small gap between adjacent units. In the circumstance, a common blow-type heat radiator impacts adjacent devices in heat radiation.

Therefore, there is a need for a heat radiator to at least partly solve the foregoing problems. Such heat radiator can be used not only in oilfield turbo fracturing units, but also in heat radiation systems of other oilfield units, generators, and the like.

SUMMARY

The objective of the present disclosure is to provide a heat radiator and a turbo fracturing unit comprising the same. The heat radiator is a suction-type heat radiator, and when a plurality of turbo fracturing units are operating in parallel, such type of heat radiator of each turbo fracturing unit will not impact the others, so as to achieve a high operation efficiency within a limited operation space. In addition, the heat radiator according to the present disclosure can regulate the speed of the gas/air guide device based on the temperature of the gas/air at the inlet, thereby avoiding energy waste and unnecessary noise. The heat radiator is provided therein with a noise reduction core which allows the gas/air to flow through the streamlined curved surface thereof, to further reduce noise without impacting the gas/air flow.

According to a first aspect of the present disclosure, there is provided a heat radiator, comprising:

- a cabin which is provided thereon with at least one inlet and an outlet;
- a heat radiation core disposed at the inlet, the heat radiation core allowing a gas/air to pass therethrough;
- a gas/air guide device disposed at the outlet, the gas/air guide device for suctioning the air within the cabin to the outlet; and
- a noise reduction core disposed within the cabin, the noise reduction core being of a structure progressively converging to the outlet;
- wherein the heat radiator is configured to enable the gas/air to enter the cabin via the inlet, then sequentially pass through the heat radiation core, a surface of the noise reduction core and the gas/air guide device, and finally be discharged out of the cabin.

According to the present disclosure, the heat radiator is configured to suction in a gas/air and then discharge the same after cooling. The heat radiator is further provided therein with a noise reduction core which allows the gas/air to flow therethrough, to further reduce noise without impacting the gas/air flow.

In an embodiment, the noise reduction core comprises:

- a core substrate which is of a hollow tower structure;
- a punctured outer structure which is a hollow tower structure opening at a bottom, the punctured outer structure sleeved outside the base substrate; and
- a noise reduction for the core material which is filled between the core substrate and the punctured outer structure.

According to the present disclosure, the structure of the noise reduction core allows warm gas/air flow to flow through the streamlined curved surface of the punctured outer structure, and to contact the noise reduction material for the core via holes on the punctured outer structure to accomplish noise reduction. Since the noise reduction core is a hollow structure, the overall weight of the heat radiator will not be affected. Moreover, the punctured panel can also prevent the broken or shed noise reduction material from being wound onto blades of a fan (i.e., an example of the gas/air guide device) and further damaged the same.

In an embodiment, the heat radiation core is provided herein a channel for allowing the target fluid to flow therethrough, and the heat radiation core is configured to enable heat exchange between the gas/air and the target fluid within the channel when the gas/air flows through the heat radiation core.

According to the present solution, the heat radiator can cool multiple types of target fluids. For example, the heat radiator may be a heat radiator especially for oil, which with oil as the target fluid; or a heat radiator especially for water, which with water as the target fluid.

In an embodiment, the heat radiator further comprises:

- a temperature sensor which is disposed at an inlet of the channel and configured to sense temperature of the target fluid at the inlet; and
- a control device which is communicatively connected with the temperature sensor and a motor for controlling the gas/air guide device, and configured to control the gas/air guide device to operate at a speed less than a rated value when the temperature of the target fluid sensed by the temperature sensor is lower than a predetermined value.

In an embodiment, the gas/air guide device is a fan, and the control device is configured to control the fan to operate at a rotating speed less than a rated rotating speed when the temperature of the target fluid sensed by the temperature sensor is lower than a predetermined value.

According to the two solutions as mentioned above, the heat radiator can regulate the operating speed of the gas/air guide device based on the temperature of the target fluid at the inlet, thereby avoiding energy waste and unnecessary noise.

In an embodiment, the predetermined value pre-stored in the control device is set based on the following criteria that: during at least half of a predetermined operation cycle of the heat radiator, the temperature of the target fluid sensed by the temperature sensor is lower than the predetermined value.

According to this solution, the gas/air guide device operates at a speed lower than the rated value during at least half of the operation period, and such arrangement can save energy resources and avoid unnecessary noise.

In an embodiment, an outer surface of the heat radiation core is provided with a louver protection layer that comprises a plurality of blades each having a blade guard panel, a blade punctured panel, and a noise reduction layer disposed between the blade guard panel and the punctured blade panel.

According to the solution, the noise generated at fins of the heat radiation core can be absorbed by the noise reduction material on the blades. In addition, after the work of the heat radiator is completed, the blades of the louver protection layer are closed to protect the heat radiation core from getting wet in case of rain, to avoid attachment of silicon dust and guar gum powder suspended in the air, or to prevent the fins of the heat radiation core from being blocked due to dust accumulation. During travelling, the blades of the louver protection layer can be closed to protect the heat radiation core from being damaged by the flying sand, branches, and other debris.

In an embodiment, the cabin at the outlet is provided with a cabin guard panel surrounding the gas/air guide device, the cabin guard panel comprising a punctured panel, an upper guard panel, and a panel noise reduction material filled between the punctured panel and the upper guard panel.

According to the solution, the gas/air flow contacts the noise reduction material via holes on the punctured panel when flowing through the cabin guard panel, to further reduce the noise. Furthermore, the punctured panel of the cabin guard panel is provided to prevent fragments of the noise material broken or shed after a long service time from impacting other components.

In an embodiment, the inlet is disposed at a side of the cabin, at least one of the heat radiation cores is disposed at the inlet, each of the heat radiation cores is formed in a vertical plate structure, and the heat radiation cores are connected end to end, which allow the gas/air to pass therethrough. The outlet is disposed at a top of the cabin. Alternatively, the cabin at a top is provided with an inlet, and the outlet is disposed at a side of the cabin where no inlet is provided.

According to the solution, the heat efficiency of the heat radiator can be increased. The producers can arrange the positions of the outlet and the inlets of the heat radiator according to the actual use needs.

In an embodiment, a surface of the noise reduction core opposite the inlet is of a recessed shape.

In an embodiment, the noise reduction core is of a shape including a pyramid, cone, or truncated cone.

According to the two solutions, as mentioned above, several options on the shape of the noise reduction core are given, which can facilitate the gas/air flow when reducing noise.

In an embodiment, the heat radiator is a cabin or barrel heat radiator.

According to another aspect of the present disclosure, there is provided a turbo fracturing unit comprising the heat radiator according to any of the above solutions.

According to this solution, the heat radiator of the turbo fracturing unit is provided therein with a noise reduction core which allows the gas/air to flow therethrough, to reduce noise without affecting the gas/air flow.

BRIEF DESCRIPTION OF THE DRAWINGS

For the sake of better understanding on the above and other objectives, features, advantages, and functions of the present disclosure, the preferred embodiments are provided with reference to the drawings. The same reference symbols refer to the same components throughout the drawings. It would be appreciated by those skilled in the art that the drawings are merely provided to illustrate preferred embodiments of the present disclosure, without suggesting any limitation to the protection scope of the present application, and respective components therein are not necessarily drawn to scale.

LIST OF REFERENCE SYMBOLS

Figure 1:
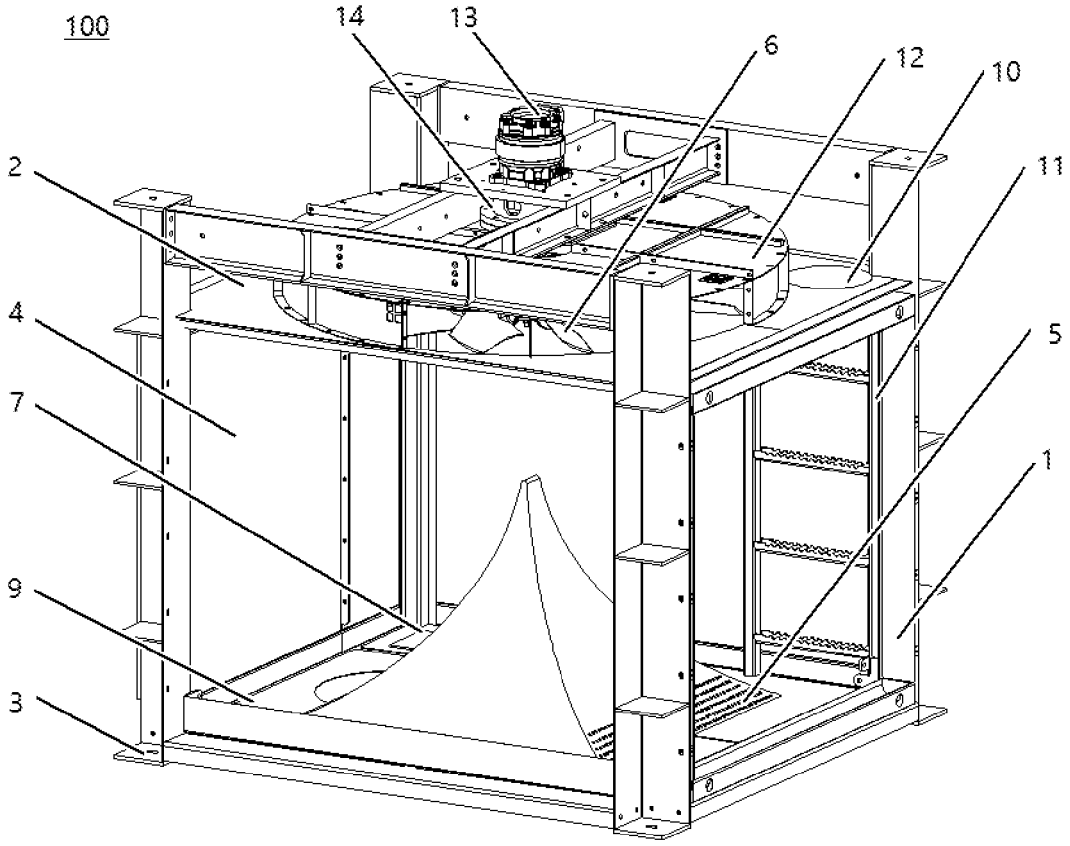
FIG. 1 is a schematic diagram of a heat radiator according to preferred embodiments of the present disclosure, where some external features are removed to expose its internal structure.

100 heat radiator
1 vertical frame structure
2 cabin guard panel

21 punctured panel
22 noise reduction material for guard panel
3 cabin base
4 heat radiation core
41 inlet of target fluid
42 outlet of target fluid
5 noise reduction core
51 core substrate
52 punctured outer structure
53 noise reduction material for core
6 gas/air guide device
7 dust discharging hole
9 cabin bottom guard
10 manhole cover
11 ladder
12 fan protection structure
13 motor
14 motor base
15 louver protection layer
151 protection layer frame
152 blade
1521 punctured blade panel
1522 blade guard panel
1523 noise reduction layer
16 temperature sensor
17 control device
200 first turbo fracturing unit
201 first engine
202 first heat radiator
300 second turbo fracturing unit
301 second engine
302 second heat radiator

DETAILED DESCRIPTION OF EMBODIMENTS

Reference now will be made to the drawings to describe embodiments of the present disclosure. What will be described herein are only preferred embodiments according to the present disclosure. On the basis, those skilled in the art would envision other embodiments of the present disclosure which all fall into the scope of the present disclosure.

Figure 2:
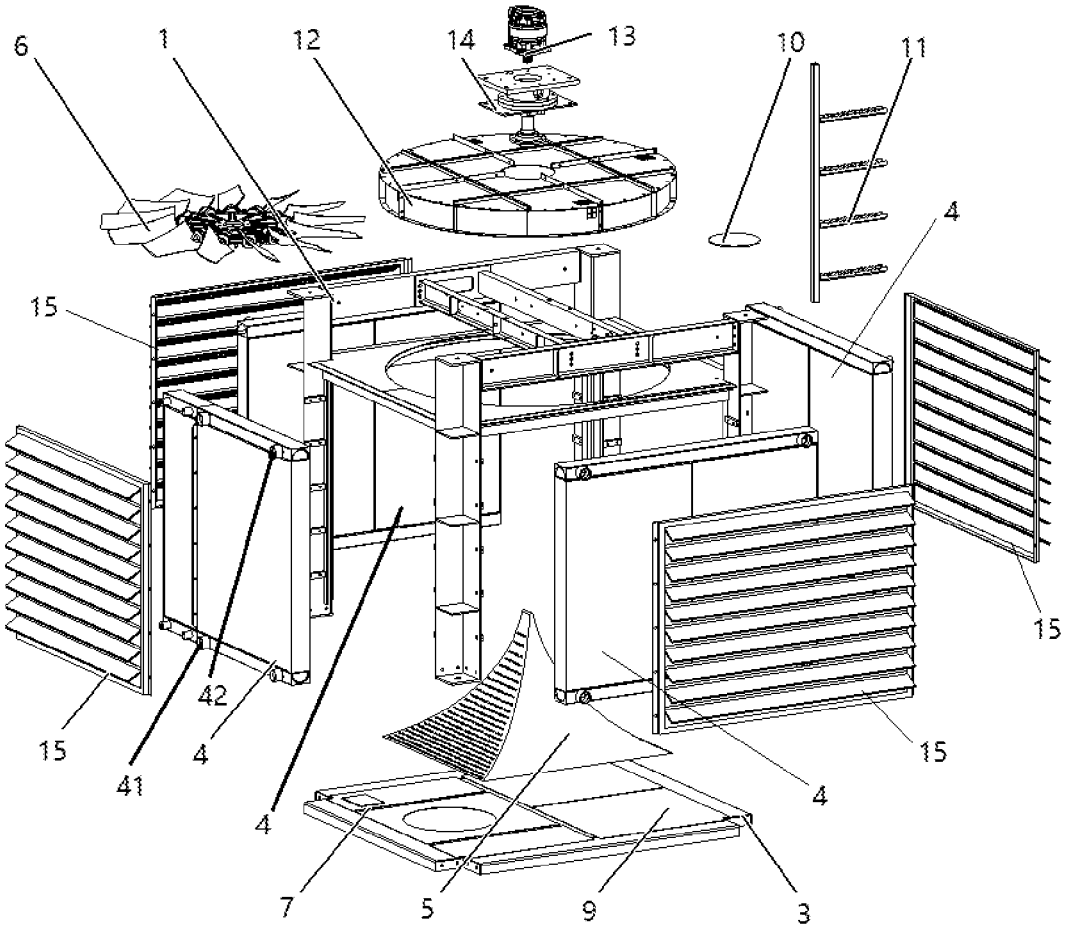
FIG. 2 is an exploded view of the heat radiator according to preferred embodiments of the present disclosure.
Figure 3:
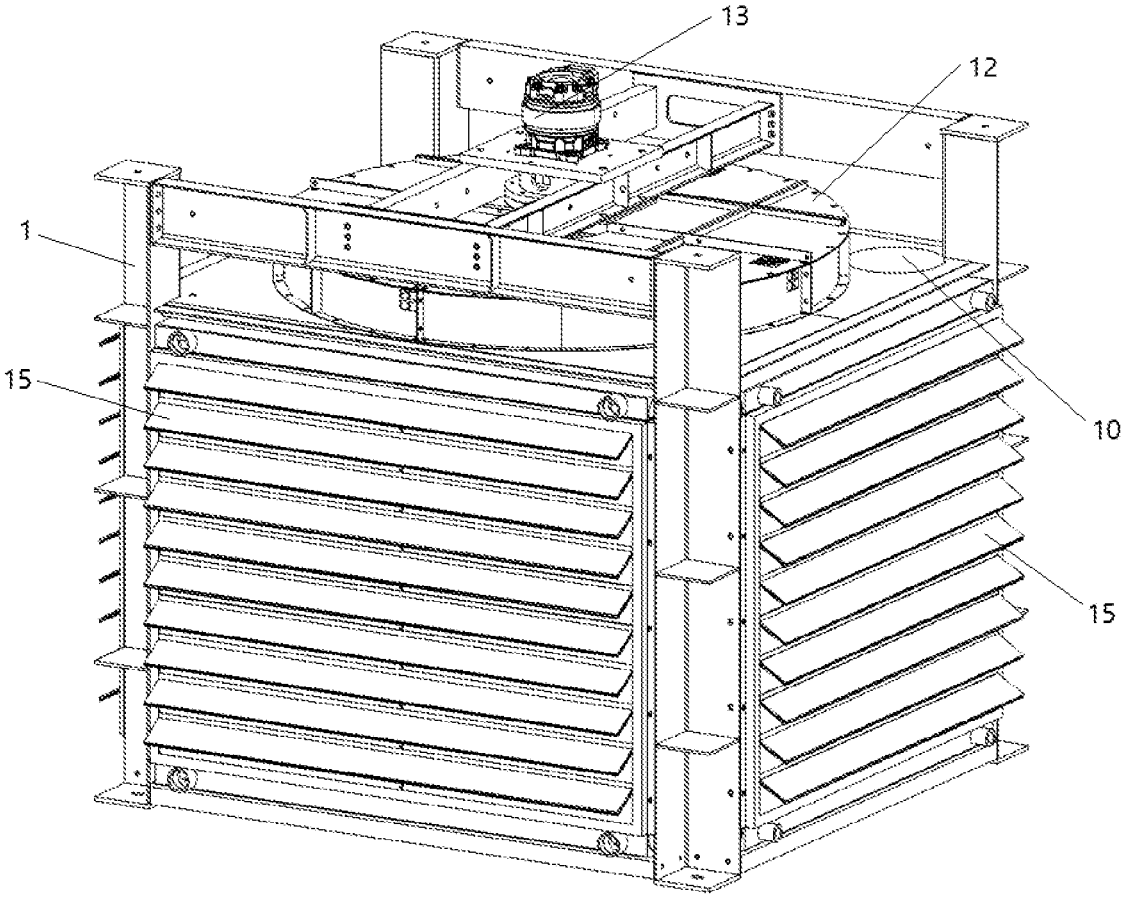
FIG. 3 is an assembled view of the heat radiator according to preferred embodiments of the present disclosure.

The present disclosure provides a heat radiator. FIGS. 1-9 illustrate multiple preferred embodiments of the present disclosure. It is worth noting that directional terms as described herein are provided illustratively, rather than restrictively, and the respective directional terms are to be read with reference to the heat radiator as shown in FIGS. 1-3. For example, "top of a cabin" as described herein is to be read as a part of the cabin opposite a horizontal plane where the cabin is placed, with or without a top wall; "side of a cabin" is to be read as a part of the cabin facing the outside connected between the top and the horizontal plane. "Top" and "side" of a cabin are both conceptual terms, which do not necessarily include a physical structure. For example, as will be described below, the cabin may be a frame structure comprised of columns and beams, with sides being an open structure.

Noise of a heat radiator is mainly sourced from two parts: wind whistle generated when air flows through the heat radiation core; and aerodynamic noise generated by tips of high-speed rotating fans. In order to reduce noise from the two sources, the present disclosure provides multiple improvements.

Reference will now be made to FIGS. 1 and 2, a heat radiator 100 is used as an example, which is a shelter type heat radiator including a cabin comprised of a vertical frame structure 1, heat radiation cores 4, a gas/air guide device 6, a noise reduction core 5, and the like. Wherein, the vertical frame structure 1 may be in the form of columns, which can form a cabin in a substantially cuboid structure via beam connection. For example, as shown in FIG. 1, two adjacent columns are connected via two parallel beams and a further beam therebetween. Of course, other connections are also feasible. In other embodiments not shown, the cabin may be a barrel type or the like.

As shown in FIG. 1, in this embodiment, the cabin is provided with an inlet at each of its four sides, respectively, and an outlet at its top. In other embodiments not shown, the inlet(s) and outlet(s) may be arranged at other positions. For example, the cabin may be provided with an inlet at its top, and an outlet may be disposed at the side of the cabin where no inlet is provided. The various arrangements of the inlet(s) and outlet(s) may be chosen by producers according to the actual needs.

The heat radiation core 4 is a vertical structure, preferably a vertical plate structure as shown in FIG. 2, which is disposed between adjacent columns within the cabin and blocks the inlets. The heat radiation core 4 is provided thereon with fins for cooling airflow. The noise reduction core 5 is disposed in the center of the cabin and forms a structure progressively converging from the bottom to the outlet of the cabin (i.e., to the top in this embodiment). Preferably, the surface of the noise reduction core 5 facing the inlets of the cabin (i.e., facing the heat radiation core 4) is a recessed streamlined curve surface. The gas/air guide device 6 is disposed at the outlet of the top of the cabin. The gas/air guide device 6 is a fan, for example, and a fan protection structure 12 (e.g. a protective net) is disposed outside the fan. A motor 13 is mounted on the fan protection structure 12 via a motor base 14 to supply power to the gas/air guide device 6. In other embodiments not shown, the gas/air guide device 6 may be a mechanism, such as an exhaust fan, vacuum pump, and the like.

Still referring to FIG. 2, each side of the cabin is provided with a heat radiation core 4. Each heat radiation core 4 is formed in a vertical plate structure, and all of the heat radiation cores 4 are connected end to end. During operation, the heat radiator 100 can draw the air outside the cabin from any position of its sides into the cabin and enables the air to flow through the heat radiation cores 4 to achieve cooling. Such arrangement can improve the heat radiation efficiency of the heat radiator 100. However, the number of heat radiation cores 4 at each side is not limited to one. Instead, each side of the cabin may be provided with a plurality of heat radiation cores 4 that are arranged vertically or laterally end to end.

In an embodiment, the heat radiation core 4 is provided therein with a channel allowing a target fluid (heat transfer fluid or coolant) to flow therethrough, and configured to enable heat exchange between the gas/air and the target fluid within the channel when the gas/air flows through the heat radiation core 4, so as to cool the target fluid. Referring to FIG. 2, an inlet 41 of the channel of the heat radiation core 4 may be disposed at the bottom of the heat radiation core 4, and an outlet 42 of the target fluid of the heat radiation core 4 may be disposed at the top of the heat radiation core 4. For example, the target fluid may be oil, and the heat radiator may be a heat radiator especially designed for circulating oil accordingly. Alternatively, the target fluid may be water, and the heat radiator may be a heat radiator especially designed for water circulation accordingly. Alternatively, the heat radiator may be provided therein with channels allowing other target fluids to flow therethrough. Preferably, the heat radiation core 4 at its outer surface is provided with fins to increase a contact area between the heat radiation core 4 and the gas/air.

Figure 4:
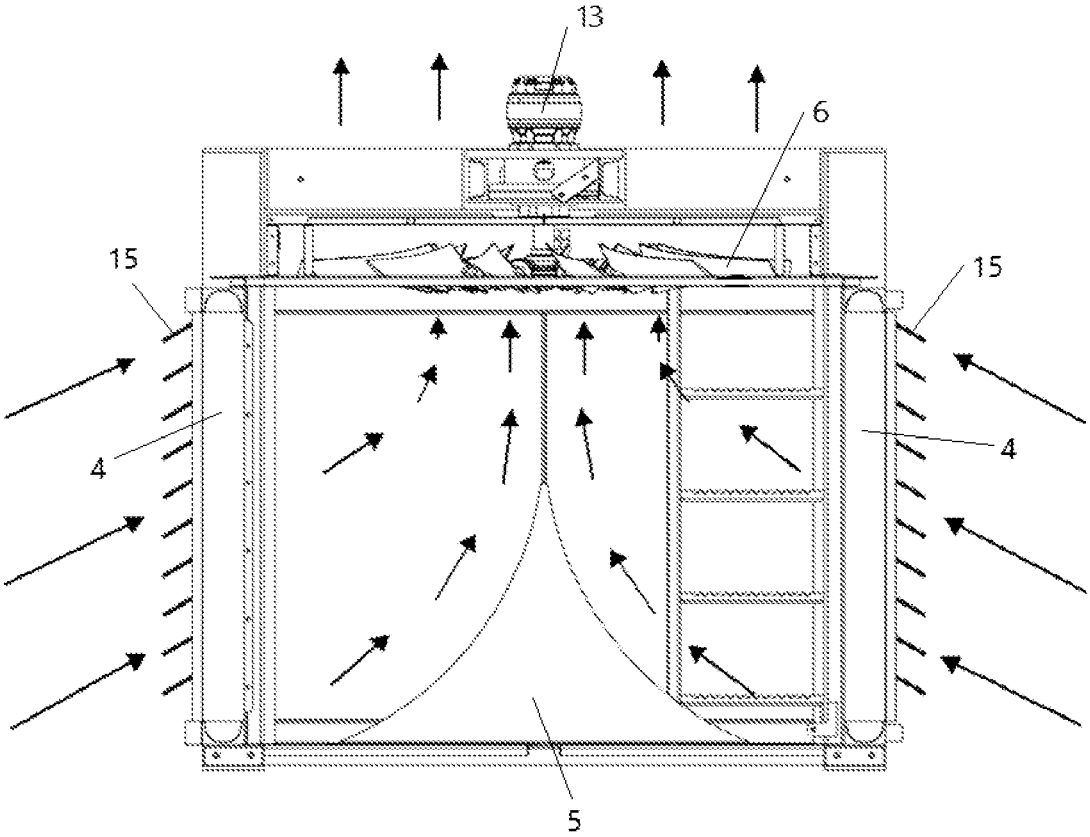
FIG. 4 is a front view of the heat radiator according to embodiments of the present disclosure, where some external features are removed to expose its internal structure.

A flow path of airflow flowing through the heat radiator 100 is indicated by arrows in FIG. 4. Referring to FIG. 4, warm airflow can flow into the cabin from the inlets thereof, then sequentially through the smooth streamlined curved surface of the noise reduction core 5, the gas/air guide device 6 and finally out of the cabin. Being a suction-type heat radiator, the heat radiator 100 does not affect other heat radiators in the vicinity during operation. The gas/air flows through the streamlined curved surface of the noised reduction core 5 to further reduce noise without impacting the gas/air flow.

Figure 8:
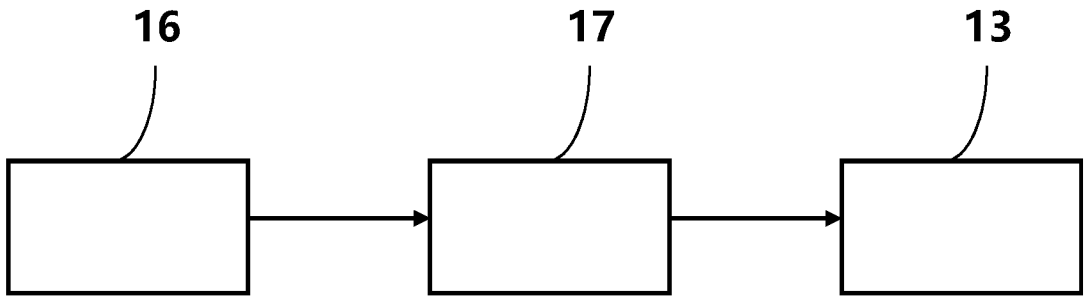
FIG. 8 is a schematic diagram of communication among a temperature sensor, control device and motor according to preferred embodiments of the present disclosure.

The heat radiator 100 further includes a temperature sensor 16 and a control device 17. The communication among the temperature sensor 16, the control device 17 and the motor 13 is shown in FIG. 8 in which arrows indicate a transmission direction of a signal. More specifically, the temperature sensor 16 is disposed at the inlet 41 of the oil path of the heat radiation core 4 and configured to sense the temperature of the target fluid at the inlet, and can transmit a sensor signal containing sensing temperature information to the control device 17. The control device 17 is communicatively connected with the temperature sensor 16 and the motor 13 for controlling the gas/air guide device 6. Upon receiving a signal from the temperature sensor 16, the control device 17 is configured to determine whether the temperature of the target fluid sensed by the temperature sensor 16 is lower than a predetermined value, and further send a control signal to the motor 13 when determining that the temperature of the target fluid sensed by the temperature senor 16 is lower than the predetermined value, to control the gas/air guide device 6 to operate at a speed less than a rated value. When the gas/air guide device 6 is a fan, the control device 17 can control the fan to rotate at a rotating speed less than a rated rotating speed when the temperature of the target fluid sensed by the temperature sensor 16 is lower than the predetermined value.

It would be appreciated that, if the temperature of the target fluid at the inlet is higher than or equal to the predetermined value, suction should be accelerated to propel the airflow, so as to fulfill the predetermined cooling purpose. Therefore, the operating speed of the gas/air guide device 6 is increased when the temperature of the target fluid at the inlet is high. Otherwise, it is unnecessary to operate the gas/air guide device 6 at a high speed. When the gas/air guide device 6 operates at a relatively low speed (for example, the fan is rotating at a low speed), the noise can be reduced as much as possible.

Preferably, a predetermined value pre-stored in the control device 17 is set based on the following criteria that: during at least half of a predetermined operation cycle of the heat radiator 100, temperature of the gas/air at the inlet sensed by the temperature sensor 16 is lower than a predetermined value. In this arrangement, the gas/air guide device 6 operates at a speed lower than the rated value during at least half of the operation period, to save energy resources and avoid unnecessary noise.

Figure 5:
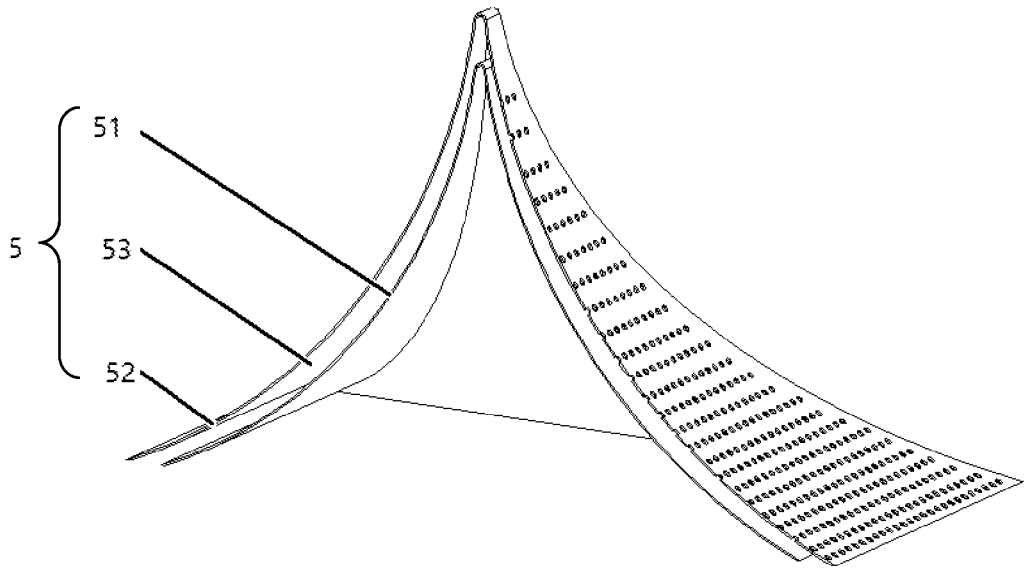
FIG. 5 is a schematic diagram of a noise reduction core of the heat radiator according to preferred embodiments of the present disclosure.

Also preferably, referring to FIG. 5, the noise reduction core 5 includes a core substrate 51, a punctured outer structure 52, and noise reduction material for the core 53. The core substrate 51 is a hollow tower structure; and the punctured outer structure 52 is a hollow tower structure that opens at the bottom. The surface of the tower structure may be an overall smooth curved surface, or may be comprised of a plurality of facets. Each of the outwardly orientated surfaces of the punctured outer structure 52 is preferably of a recessed shape, and the shape of the punctured outer structure 52 is adapted to be sleeved outside the core substrate 51. The punctured outer structure 52 and the core substrate 51 are not necessarily in shape fit. The core substrate 51 may be of any shape as long as it, together with the punctured outer structure 52, can form a hollow structure. The noise reduction material for the core 53 is filled between the core substrate 51 and the punctured outer layer. Such structure allows the warm airflow to flow through the streamlined curved surface of the punctured outer structure 52, and to contact the noise reduction material for the core 53 via holes on the punctured outer structure 52 to reduce noise. Since the noise reduction core 5 is a hollow structure, the overall weight of the heat radiator will not be increased remarkably. Referring to FIGS. 2 and 3, the heat radiation core 4 at the outer surface is provided with a louver protection layer 15 for protecting the heat radiation core 4.

Figure 6:
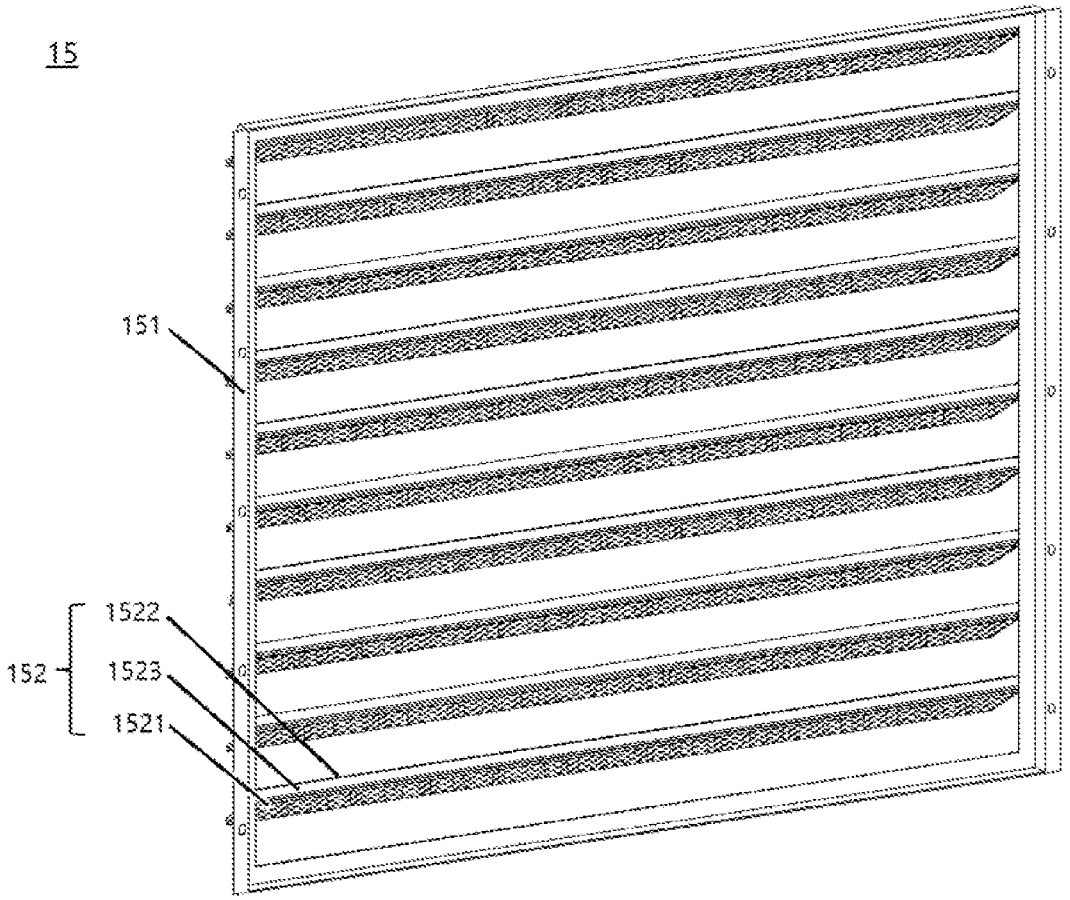
FIG. 6 is a schematic diagram of a louver protection layer of the heat radiator according to preferred embodiments of the present disclosure.

The specific structure of the louver protection layer 15 is illustrated in FIG. 6. The louver protection layer 15 includes a protection layer frame 151 and a plurality of parallel blades 152 within the protection layer frame 151; and the blade 152 includes a blade guard panel 1522, a punctured blade panel 1521, and a noise reduction layer 1523 disposed between the blade guard panel 1522 and the punctured blade panel 1521. When the heat radiator is operating, the blades 152 are opened at an angle less than 90 degrees relative to the vertical line such that the noise reduction material obliquely faces the heat radiation core 4. The noise generated at the fins of the heat radiation core 4 can be absorbed by the noise reduction material on the blades 152. In addition, the punctured blade panel 1521 is provided to prevent fragments of the noise reduction material from being suctioned and stuck between fins of the heat radiation core 4 and blocking the latter due to the noise reduction material broken or shed after a long service time.

When the heat radiator 100 is operating, the blades 152 of the louver protection layer are at an open state to guarantee smooth air intake. After the work of the heat radiator 100 is completed, the blades 152 of the louver protection layer 15 are closed to protect the heat radiation core 4 from getting wet in case of rain, to avoid attachment of silicon dust and guar gum powder suspended in the air, or to prevent the fins of the heat radiation core 4 from being blocked due to dust accumulation. During travelling, the blades 152 of the louver protection layer 15 can be closed to protect the heat radiation core 4 from being damaged by the flying sand, branches, and other debris.

Figure 7:
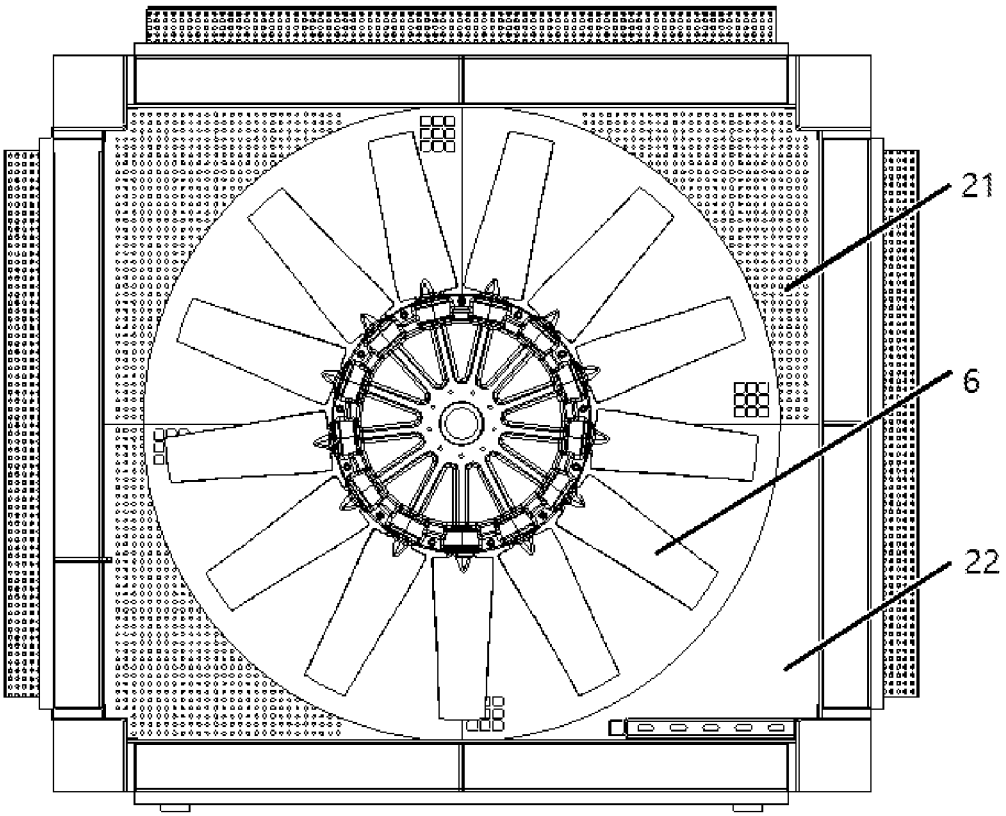
FIG. 7 is a bottom view of a top structure of the heat radiator according to preferred embodiments of the present disclosure, where some features of a cabin guard panel are removed to expose external a noise reduction material therein.

The heat radiator 100 at its top may be provided with a noise reduction structure, and a preferred embodiment of the top structure of the heat radiator 100 is shown in FIG. 7 which illustrates a bottom view of the top structure. The heat radiator 100 includes a cabin guard panel 2 which includes a punctured panel 21 at its bottom surface, an upper guard panel at its top surface, and a noise reduction material for the guard panel 22 disposed between the punctured panel 21 and the upper guard panel. For illustration, part of the punctured panel 21 of the cabin guard panel 2 in FIG. 7 is removed to expose the noise reduction material for the guard panel 22. With such arrangement, the airflow can contact the noise reduction material via holes on the punctured plate 21 when flowing through the cabin guard panel 2, so as to further reduce noise. Moreover, the punctured panel 21 can also secure the noise reduction material to prevent the broken or shed noise reduction material from being wound onto the blades 152 of the gas/air guide device 6 and further damaged the same.

On the other hand, since it is easy to accumulate dust and collect water (if raining) at the bottom of the heat radiator 100, the heat radiator 100 should be maintained periodically. As shown in FIGS. 1 and 2, in the embodiment, the cabin base 3 is mounted thereon with a cabin bottom guard panel 9; the cabin bottom guard panel 9 is provided thereon with a dust discharging hole 7; the cabin guard panel 2 is provided thereon with a manhole which is covered by a manhole cover 10; and a ladder 11 is connected between the manhole and the bottom protection panel. During maintenance, the maintenance personnel enter the cabin through the manhole and the ladder 11 and then perform maintenance on the heat radiator 100 via a maintenance channel on the bottom panel, to clear the water, dust and others through the dust discharging hole 7.

The noise reduction core 5 disposed in the center of the bottom within the cabin is prone to collect dust, making the noise reduction material blocked and deteriorating the noise reduction effect. The noise reduction core 5 of the above configuration can facilitate maintenance where only the noise reduction material needs to be purged and replaced regularly. As a result, such arrangement significantly reduces the maintenance time and costs.

In addition to the above specific structure, the heat radiator 100 may be of other alternative structure not shown in the drawings. For example, the noise reduction core 5 may be of a pyramid, cone, truncated cone, or other shape, or may be of an irregular shape. Likewise, the motor 13 may be a hydraulically driven motor, electric motor, pneumatic motor, or the like. Moreover, the heat radiator 100 as discussed above may be a radiator especially for lubricating oil, or may be a heat radiator especially for water or other type of heat radiator integrated with an engine.

Figure 9:
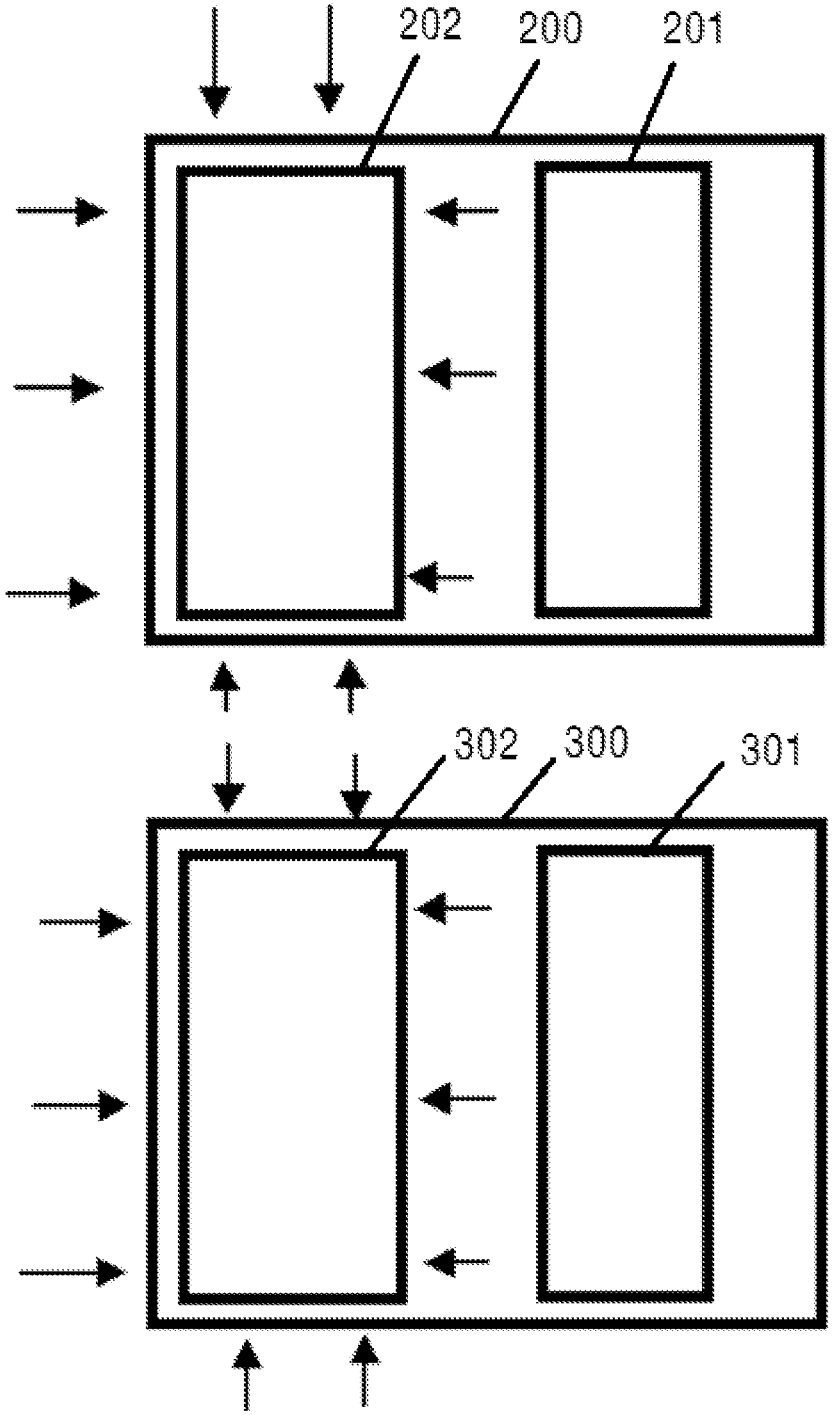
FIG. 9 is a schematic diagram of top surfaces of two turbo fracturing units disposed in parallel according to preferred embodiments of the present disclosure.

In the present disclosure, there is provided a turbo fracturing unit comprising the heat radiator as mentioned above. A plurality of turbo fracturing units may be provided in set. For example, as shown in FIG. 9, two turbo fracturing units may be disposed in parallel on the ground. Wherein, a first turbo fracturing unit 200 in the two turbo fracturing units includes a first engine 201 and a first heat radiator 202 at its journal neck, and a second turbo fracturing unit 300 includes a second engine 301 and a second heat radiator 302 at its journal neck. Since the first heat radiator 202 and the second heat radiator 302 are cabin heat radiation units as shown in FIGS. 1-7, the first heat radiator 202 and the second heat radiator 302 suction in warm airflow from the side surfaces and then discharge the cooled airflow from the top, respectively, and the flow direction when the gas/air is suctioned in is indicated with arrows as shown in FIG. 9. It can be seen that, since the first heat radiator 202 and the second heat radiator 302 are suction-type heat radiators, the heat radiator of each turbo fracturing unit will not impact others when a plurality of turbo fracturing units are operating in parallel, such that a high operation efficiency can be achieved within a limited operation space.

The heat radiator according to the present disclosure is provided with multiple noise reduction means. Wherein, the heat radiator can regulate the speed of the gas/air guide device based on the temperature of the gas/air at the inlet, thereby avoiding energy waste and unnecessary noise. The heat radiator is provided therein with a noise reduction core which allows the gas/air to flow through the outer surface of the noise reduction core, so as to further reduce noise without impacting the gas/air flow. In addition, the heat radiator is a suction-type heat radiator, and such type of heat radiator of each turbo fracturing unit will not impact others when a plurality of turbo fracturing units are operating in parallel, such that a high operation efficiency can be achieved within a limited operation space.

The foregoing description on the various embodiments of the present disclosure has been presented to those skilled in the relevant fields for purposes of illustration, but are not intended to be exhaustive or limited to a single embodiment disclosed herein. As aforementioned, many substitutions and variations will be apparent to those skilled in the art. Therefore, although some alternative embodiments have been described above, those skilled in the art can still envision or develop other embodiments much more easily. The present disclosure is intended to cover all substitutions, modifications and variations of the present disclosure as described herein, as well as other embodiments falling into the spirits and scope of the present disclosure.

We claim:

1. A heat radiator, characterized in that the heat radiator comprises:

a cabin comprising an air outlet and an air inlet;

a heat radiation core disposed at the air inlet with coolant therein;

an air suction device disposed at the air outlet;

a temperature sensor disposed within the coolant for measure a temperature of the coolant;

a noise reduction structure disposed within the cabin and being progressively converging to the air outlet from a base of the cabin; and a controller for adaptively adjust an amount of an air flow from outside of the air inlet, through the cabin, to the air outlet.

2. The heat radiator according to claim 1, wherein the noise reduction structure comprises:

a core substrate having a hollow tower structure;

a punctured outer structure in a form of a hollow tower structure opening at the base, the punctured outer structure being sleeved outside the core substrate; and a noise absorption material filled between the core substrate and the punctured outer structure.

3. The heat radiator according to claim 1, wherein a surface of the noise reduction structure facing the air inlet is of a recessed shape.

4. The heat radiator according to claim 1, wherein the noise reduction structure is shaped in a pyramid, a cone, or a truncated cone converting to the air outlet.

5. The heat radiator according to claim 1, wherein the heat radiation core is provided with a channel for confining the coolant to cool the air flow via a heat exchange.

6. The heat radiator according to claim 5, wherein the channel of the heat radiation core comprises a coolant inlet and a coolant outlet for circulating the coolant through the channel.

7. The heat radiator according to claim 5, wherein the coolant comprises water or oil.

8. The heat radiator according to claim 1, wherein the air suction device comprises a suction fan driven by a motor.

9. The heat radiator according to claim 8, wherein the controller is configured to adjust the amount of the air flow by controlling a rotational speed of the motor according to a comparison of the measured temperature of the coolant with a temperature threshold.

10. The heat radiator according to claim 9, wherein the controller is configured to turn off the motor when the measured temperature is below the temperature threshold.

11. The heat radiator according to claim 9, wherein the controller is configured to control the rotational speed of the motor to be less than a rated value when the measured temperature is lower than the temperature threshold.

12. The heat radiator according to claim 9, wherein the temperature threshold is determined at a value such that during at least half of a predetermined operation cycle of the heat radiator, the measured temperature is lower than the temperature threshold.

13. The heat radiator according to claim 1, wherein an outer surface of the heat radiation core is provided with a louver protection layer comprising a plurality of blades each having a blade guard panel, a punctured blade panel, and a noise reduction layer disposed between the blade guard panel and the punctured blade panel.

14. The heat radiator according to claim 1, wherein:

the air inlet is disposed at a side of the cabin;

the heat radiation core is disposed at the air inlet;

the heat radiation core is formed as a vertical plate structure; and the heat radiation core comprises a plurality of radiation panels connected end to end.

15. The heat radiator according to claim 14, wherein the air outlet is disposed at a top of the cabin.

16. The heat radiator according to claim 1, wherein the heat radiator comprises a cabin heat radiator or a barrel heat radiator.

17. The heat radiator according to claim 1, wherein the cabin comprises a coverable manhole for maintenance.

18. The heat radiator according to claim 17, wherein the cabin further comprises a ladder below the coverable manhole.

19. The heat radiator according to claim 1, wherein the cabin is disposed adjacent a turbine engine to draw circulating air around the turbine engine.

* * * * *